United States Patent [19]

Haheeb

[11] Patent Number: 4,909,581

[45] Date of Patent: Mar. 20, 1990

[54] DRAWER CONSTRUCTION

[75] Inventor: Peter H. Haheeb, Stockton, Calif.

[73] Assignee: American Moulding & Millwork Company, Stockton, Calif.

[21] Appl. No.: 283,458

[22] Filed: Dec. 12, 1988

[51] Int. Cl.[4] ..... A47B 48/00

[52] U.S. Cl. ..... 312/263; 312/264; 312/330.1

[58] Field of Search ..... 312/330 R, 257 R, 263, 312/264

[56] References Cited

U.S. PATENT DOCUMENTS

| | | | |
|---|---|---|---|
| 1,169,328 | 1/1916 | Holtgrewe | 312/330 X |
| 3,379,483 | 4/1968 | Oldford | 312/257 R X |
| 3,784,273 | 1/1974 | Nikolai | 312/257 R X |
| 4,036,542 | 7/1977 | Courtwright | 312/330 R |
| 4,279,455 | 7/1981 | Santo | 312/263 X |
| 4,378,137 | 3/1983 | Gibson et al. | 312/263 X |
| 4,466,675 | 8/1984 | Ferdinand et al. | 312/263 |
| 4,750,794 | 6/1988 | Vegh | 312/263 |

*Primary Examiner*—Joseph Falk

*Attorney, Agent, or Firm*—James E. Brunton

[57] ABSTRACT

A knocked down drawer assembly in which the parts are specially designed so that they can be easily interlocked and bonded together to form a drawer construction of great structural integrity. The drawer assembly does not require the use of conventional fasteners for assembly, nor does it require the use of costly clamps, corner mouldings or the like to accomplish the assembly.

7 Claims, 3 Drawing Sheets

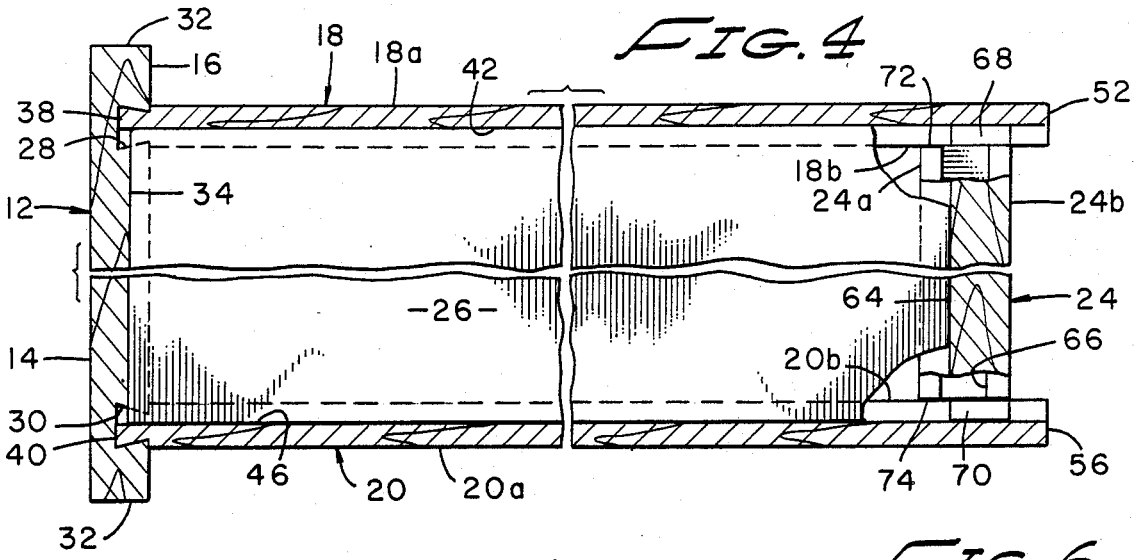
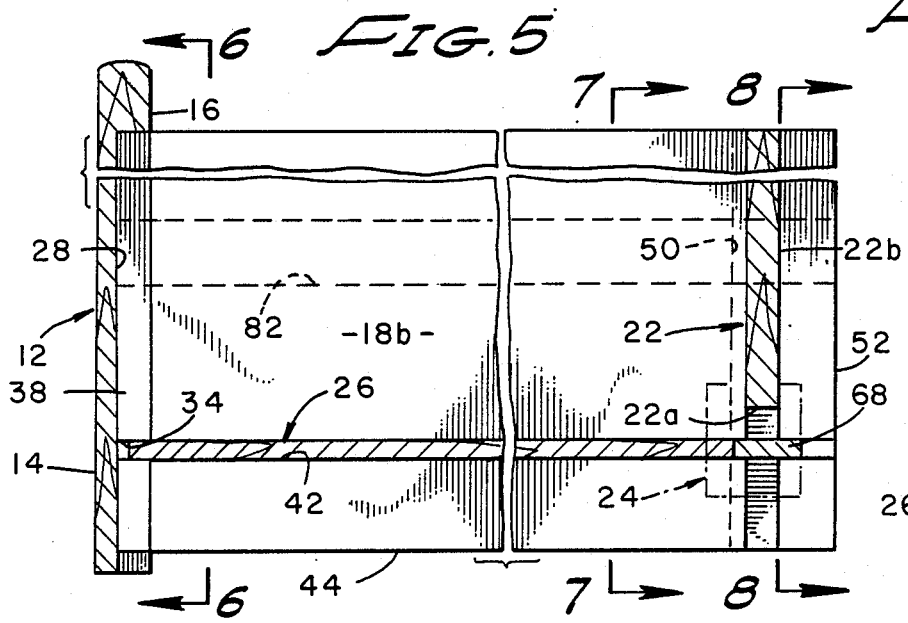
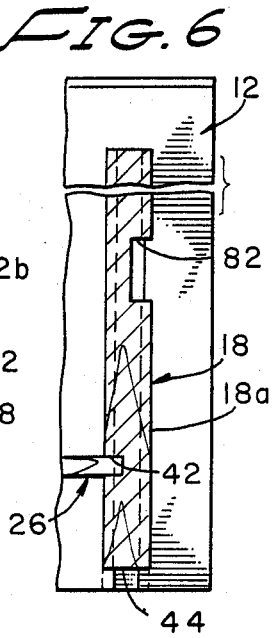
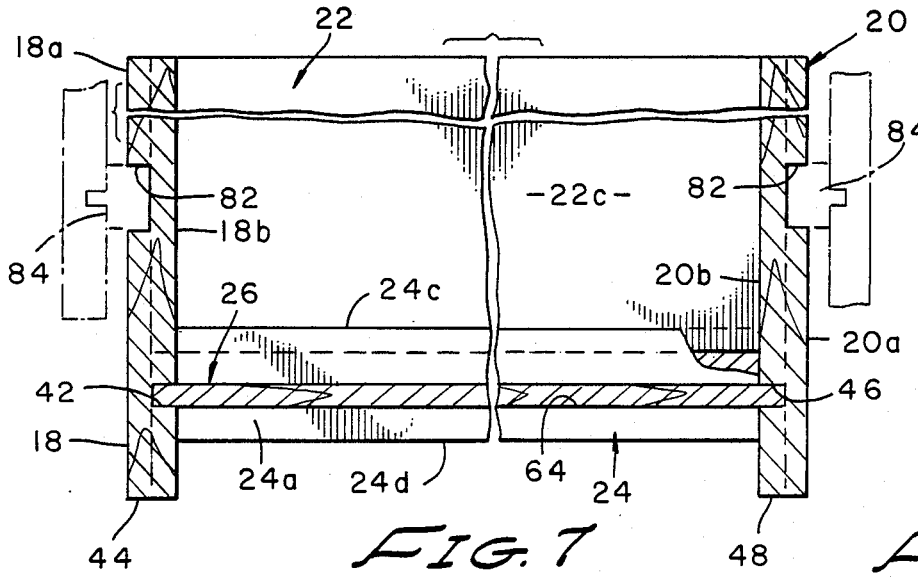
FIG. 7
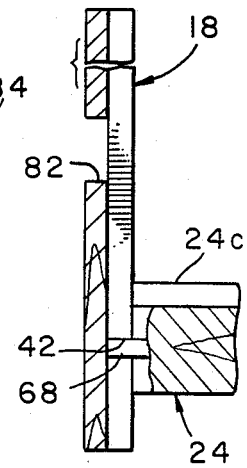
FIG. 8

DRAWER CONSTRUCTION

BACKGROUND OF THE INVENTION

1. Field of the Invention

This invention relates generally to furniture drawer construction. More particularly, the invention concerns a furniture drawer assembly of the knocked down or ready to assemble type.

2. Discussion of the Prior Art

Escalating shipping and storage costs in recent years have made so-called knocked down furniture construction quite popular. Such furniture can be compactly packaged thereby drastically reducing the space required for shipping and storage. If properly designed, such furniture can be readily assembled even by unskilled persons.

One of the major drawbacks of prior art knocked down furniture is poor design which results in difficulty of assembly and lack of structural stability. Typically, assembly of prior art knocked down furniture is accomplished using conventional fasteners such as nails, staples and screws. Such assembly can be both difficult and time-consuming. Assembly of drawers in this fashion is particularly undesirable.

Attempts have been made to provide knocked down drawers which can be assembled using clamps in lieu of conventional fasteners. U.S. Pat. No. 4,036,542 issued to Courtwright discloses this type of construction. Additionally, attempts have been made to provide knocked down drawers which embody specially constructed corner members which lockably receive the front, side and bottom panels of the drawer. U.S. Pat. No. 4,279,455 issued to Santo is exemplary of this type of construction.

The drawer assembly of the present invention overcomes the drawbacks of prior art knocked down drawer assemblies by providing a unique drawer design which does not require the use of conventional fasteners for assembly, nor does it require the use of costly clamps, corner mouldings or the like to accomplish the assembly.

SUMMARY OF THE INVENTION

It is an object of the present invention to provide a knocked down drawer assembly which does not require the use of special tools or skills to quickly and easily assemble the drawer.

It is another object of the invention to provide a knocked down drawer assembly of the aforementioned character, in which the parts thereof are uniquely designed so that they can be easily interlocked and bonded together to form a drawer construction of great structural integrity.

Another object of the invention is to provide a knocked down drawer assembly of the character described which is easy to assemble and can be inexpensively manufactured in large volume.

Yet another object of the invention is to provide a knocked down drawer assembly as described in the preceding paragraphs which does not require the use of conventional fasteners, clamps or other specially designed corner mouldings.

BRIEF DESCRIPTION Of THE DRAWINGS

FIG. 4 is a cross-sectional view taken along lines 4—4 of FIG. 2.

FIG. 5 is a cross-sectional view taken along lines 5—5 of FIG. 3.

FIG. 6 is a cross-sectional view taken along lines 6—6 of FIG. 5.

FIG. 7 is a cross-sectional view taken along lines 7—7 of FIG. 5.

FIG. 8 is a cross-sectional view taken along lines 8—8 of FIG. 5.

DESCRIPTION OF THE INVENTION

Figure 1:
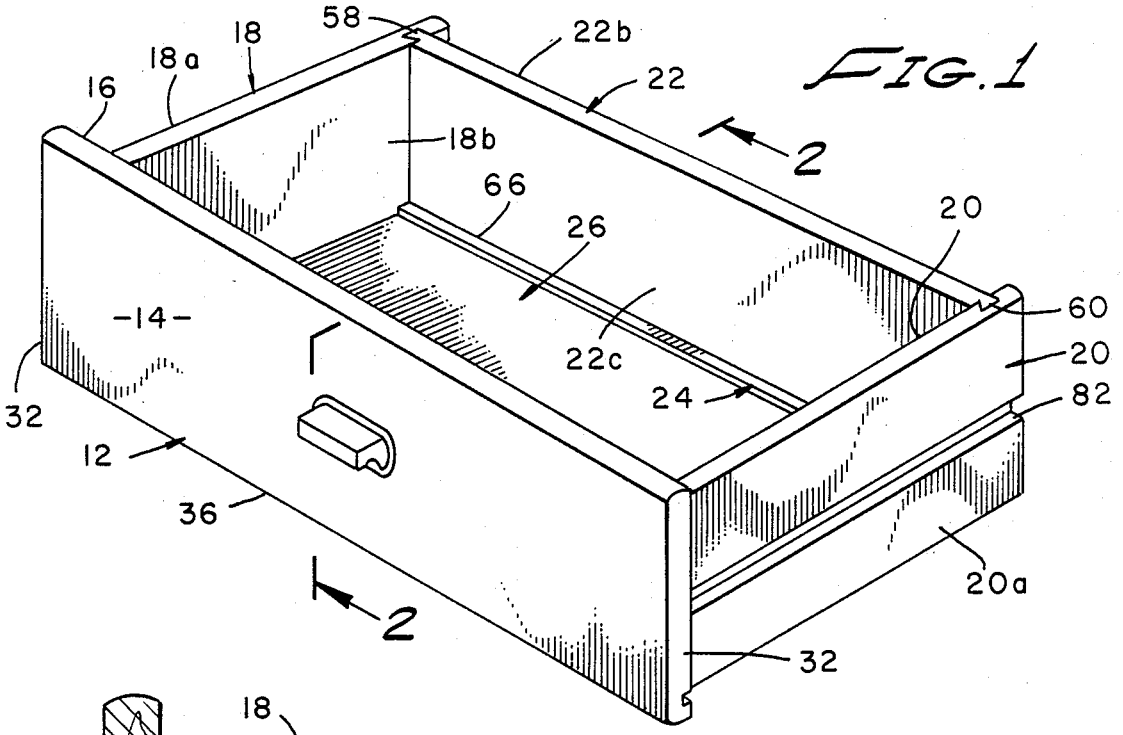
FIG. 1 is a generally perspective view of the drawer embodying the construction of the present invention.
Figure 10:
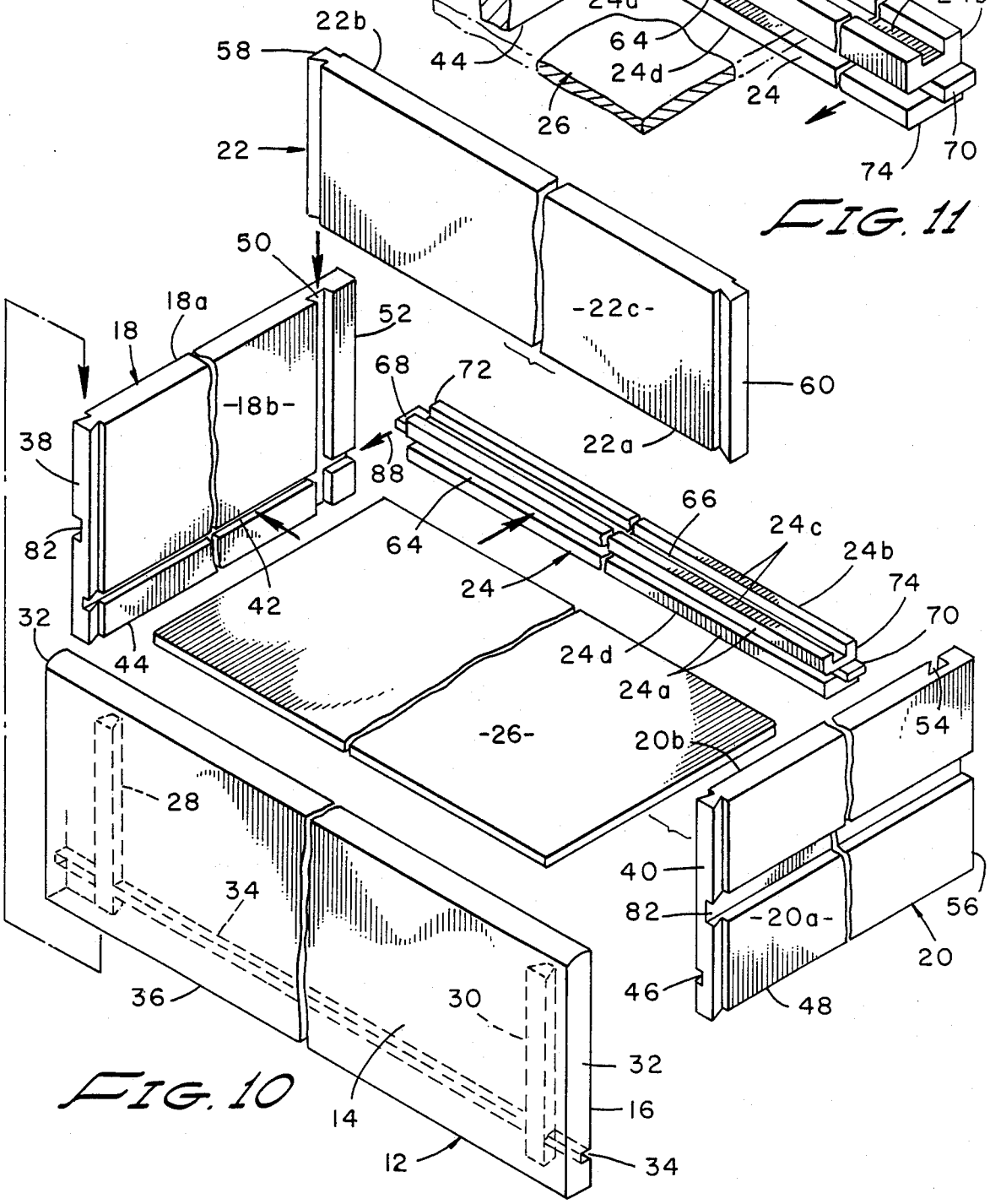
FIG. 10 is a generally perspective exploded view illustrating the manner of assembly of the various component parts of the drawer assembly of the invention.

Referring to the drawings and particularly to FIGS. 1 and 10, the furniture drawer of knocked down construction of the present invention is there illustrated. In the present embodiment of the invention, the furniture drawer comprises a front panel 12 having an outer face 14 and an inner face 16; a pair of side panels 18 and 20 each having outer faces **18*a* and 20*a*, respectively, and inner faces 18*b* and 20*b*, respectively. The furniture drawer further comprises a rear panel 22 having a lower margin 22*a*, an outer face 22*b*, and an inner face 22*c*. An important aspect of the furniture drawer of the present invention is an elongated support rail 24 having inner, outer, top and bottom faces 24*a*, 24*b*, 24*c* and 24*d*, respectively. The furniture drawer of this form of the invention further comprises a bottom panel 26**.

Figure 2:
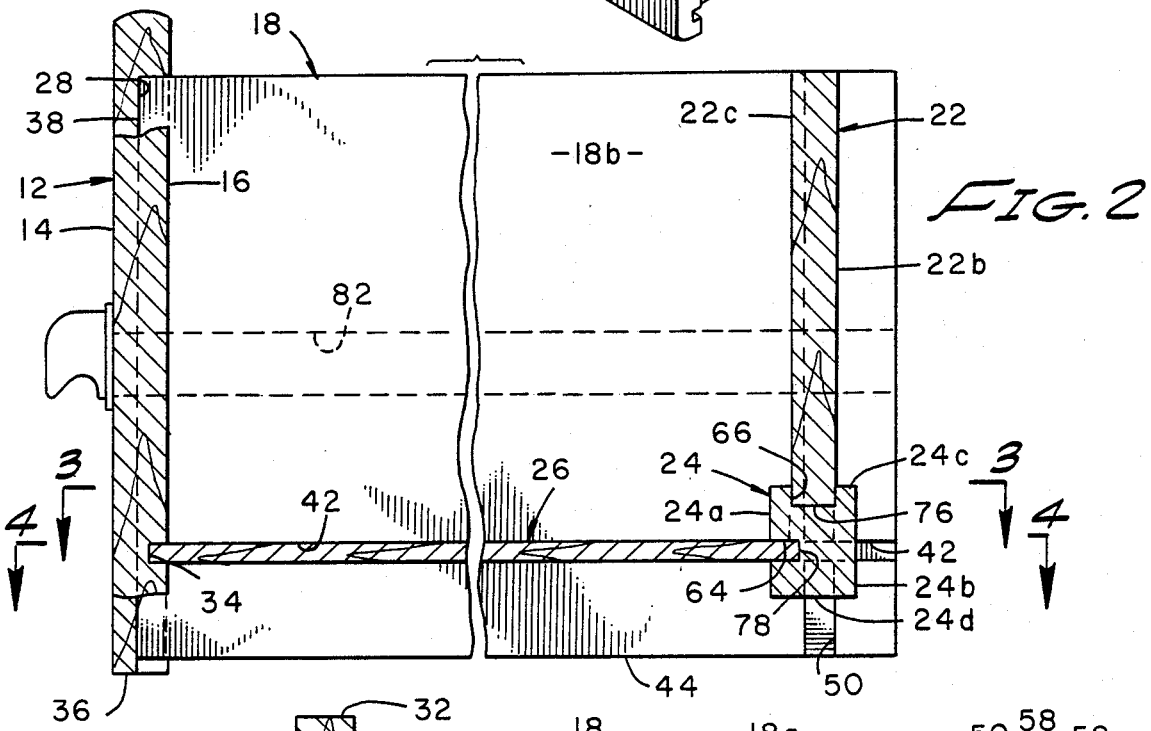
FIG. 2 is a cross-sectional view taken along lines 2—2 of FIG. 1.
Figure 3:
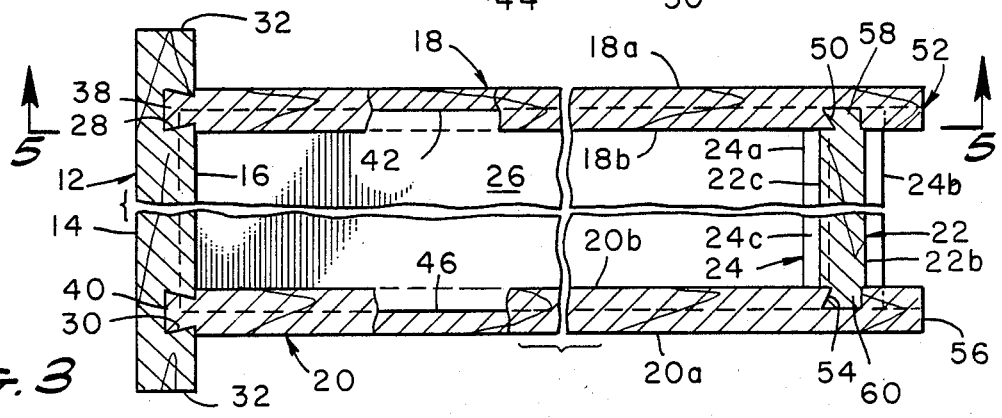
FIG. 3 is a cross-sectional view taken along lines 3—3 of FIG. 2.

As best seen by referring to FIGS. 3 and 10, front panel 12 is provided with spaced apart grooves 28 and 30 defined in inner face 16 adjacent and parallel to the vertical, marginal edges 32 of front panel 12. Front panel 12, also, has a lower groove 34 (FIG. 2) defined in inner face 16 adjacent and parallel to the lower marginal edge 36 of the front panel.

Side panel 18 includes a vertical, marginal edge 38 adapted to be closely received within the groove 28 provided in front panel 12 (FIG. 10). Similarly, side panel 20 includes a vertical, marginal edge 40 adapted to be closely received within the groove 30 provided in front panel 12. In the form of the invention illustrated in the drawings, it is to be observed that vertical, marginal edges 38 and 40 are of a male dovetail configuration, while grooves 28 and 30 are of a female dovetail marginal edges of the side panels.

Referring to FIGS. 6 and 10, it is to be observed that side panel 18 is, also, provided with a lower side panel groove 42 defined in inner face **18*b* of the side panel and located adjacent and extending parallel to the lower marginal edge 44 of side panel 18. Similarly, side panel 20 is provided with a lower side panel groove 46 defined in inner face 20*b* of the side panel and located adjacent and extending parallel to the lower marginal edge 48 of side panel 20**.

Side panel 18 is further provided with a groove 50 in inner face **18*b*. Groove 50 is disposed adjacent and parallel to vertical, marginal edge 52** of the side panel 18. In similar fashion, side panel 20 is provided with a groove 54 disposed adjacent and parallel to marginal edge 56 of panel 20.

As indicated in FIGS. 3 and 10, each vertical, marginal edge 58 and 60, respectively, of rear panel 22 is adapted to be closely received within grooves 50 and 54, respectively, formed in side panels 18 and 20. Once again, in the form of the invention shown in the drawings, grooves 50 and 54 are of a general dovetail configuration and marginal edges 58 and 60 of the rear panel are, also, of a male, general dovetail configuration adapted to be closely received within grooves 50 and 54, respectively.

Figure 9:
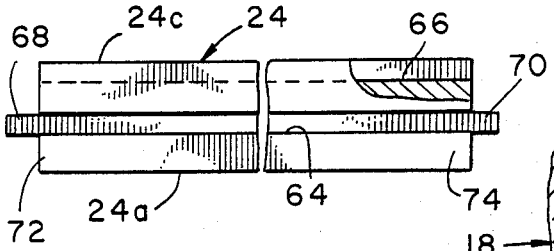
FIG. 9 is a foreshortened view partly in section of the support rail of the invention.
Figure 11:
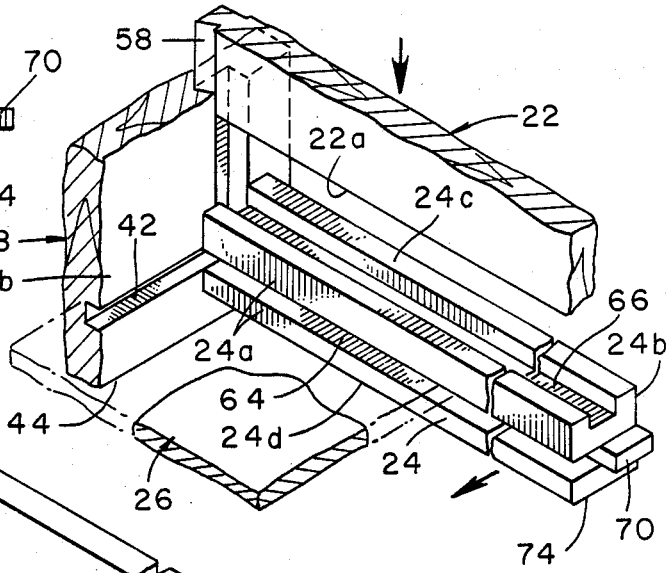
FIG. 11 is a fragmentary, perspective view of a rear corner of the drawer assembly further illustrating the method of assembly of the various components thereof.

Referring particularly to FIGS. 9, 10 and 11, support rail 24 is provided with an inner groove 64 defined in inner face 24*a* intermediate of and parallel to top and bottom faces 24c and 24*d*. Rail 24, also, includes an upper groove 66 defined to face 24*c*. Further, support rail 24 is provided with first and second tongues 68 and 70 extending outwardly from first and second ends 72 and 74, respectively, of rail 24. As best seen by referring to FIG. 2, upper groove 66 is adapted to closely receive the lower margin 76 of rear panel 22. As, also, shown in FIG. 2, groove 64 is adapted to closely receive the rear edge 78 of bottom panel 26. As indicated by the arrow 80 in FIG. 10, tongue 68 is adapted to be closely received within lower side panel groove 42 of side panel 18. In similar fashion, tongue 70 is adapted to be closely received within lower side panel groove 46 formed in side panel 20. As indicated in FIGS. 5 and 10, tongues 68 and 70 are aligned with inner groove 64 of support rails 24. Preferably, the length of tongues 68 and 70 is slightly less than the depth of the lower side panel grooves 42 and 46, respectively, so that the tongues can be easily received within grooves 42 and 46 in the manner indicated in the drawings.

Turning now to FIG. 7, it is to be observed that each of the side panels 18 and 20 is provided with a guide groove 82 in faces 18*a* and 20*a* of the side panels. Grooves 82 are adapted to closely receive guide rails 84 (Shown in phantom) provided in the piece of furniture into which the drawer assembly is slidably received.

FIGS. 5, 8, 10 and 11, particularly, illustrate the novel interlocking of the side, rear and bottom panels with the uniquely configured support rail 24. When the panels are assembled with and bonded to the support rail 24, a very strong and durable, rear portion drawer construction results. Similarly, when the edges of the side and bottom panels are assembled into grooves 28, 30 and 34 of the front panel and bonded in place, a very strong and durable front portion drawer construction results.

It is to be understood that various types of furniture adhesives can be used. Additionally, for certain designs fasteners such as nails and screws could be used without departing from the spirit of the invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A furniture drawer of knocked down construction comprising:

(a) A front panel having an outer face and an inner face and spaced apart grooves defined in said inner face adjacent and parallel to the vertical marginal edges of said front panel;

(b) A pair of side panels each having front and rear vertical marginal edges and an outer face and an inner face, said front vertical marginal edge of each respective side panel being adapted to be received in a respective spaced apart groove of said front panel, each said side panel, also, having a side panel groove defined in said inner face thereof adjacent and parallel to said rear vertical marginal edge thereof, and a lower side panel groove defined in said inner face of each respective side panel adjacent and parallel to the lower marginal edge thereof;

(c) A rear panel having vertical marginal edges, a lower margin and an outer face and an inner face, each vertical marginal edge of said panel having a male configuration adapted to be received in one of said side panel grooves provided in said side panels;

(d) an elongated support rail having inner, outer, top and bottom substantially planar faces and first and second ends, an inner groove having spaced apart, substantially parallel faces defined in said inner face intermediate of and parallel to said top and bottom faces, an upper groove defined in said upper face having spaced apart faces adapted to receive said lower margin of said rear panel and engage a portion of said outer face and inner face of said rear panel and first and second tongues extending outwardly from said first and second ends, respectively, said tongues being receivable within said lower side panel grooves of said pair of side panels; and (e) A bottom panel adapted to be received within respective lower side panel grooves of said side panels and within said inner groove defined in said inner face of said support rail.

2. A furniture drawer as defined in claim 1 in which said front panel is provided with a lower groove defined in said inner face of said front panel for receiving said bottom panel.

3. A furniture drawer as defined in claim 2 in which said tongues have a length slightly less than the depth of said lower side panel grooves of said side panels.

4. A furniture drawer as defined in claim 1 in which said tongues are aligned with said inner groove defined in said inner face of said support rail.

5. A furniture drawer as defined in claim 4 in which said tongues have a length slightly less than the depth of said lower side panel grooves of said side panels.

6. A furniture drawer as defined in claim 5 in which each of said side panels is provided with a groove defined in said outer face thereof parallel to the lower margin thereof.

7. A furniture drawer of knocked down construction comprising:

(a) A front panel having an outer face and an inner face, spaced apart grooves of female dovetail configuration defined in said inner face adjacent and parallel to the vertical marginal edges of said front panel, and a groove defined in said inner face adjacent and parallel to the lower marginal edge of said front panel;

(b) A pair of side panels having an outer face and an inner face, one vertical marginal edge of each respective side panel being of a male dovetail configuration adapted to be received within a respective spaced apart groove of said front panel, a groove of female dovetail construction defined in said inner face of each respective side panel adjacent and parallel to the opposite vertical marginal edge thereof, and a bottom panel receiving groove defined in said inner face of each respective side panel adjacent and parallel to the lower marginal edge thereof;

(c) A rear panel having a lower margin and an outer face and an inner face, each vertical marginal edge of said rear panel having male dovetail configuration adapted to be received in one of said grooves of female dovetail construction provided in said side panels;

(d) an elongated support rail having inner, outer, top and bottom faces and first and second ends, an inner groove having spaced apart substantially parallel faces defined in said inner face intermediate of and parallel to said top and bottom faces, an upper groove having spaced apart substantially parallel faces defined in said upper face adapted to receive said lower margin of said rear panel and closely engage portions of said outer and inner faces of said rear panel and first and second tongues extending outwardly from said first and second ends, respectively, said tongues being aligned with said inner groove in said inner face of said support rail and being receivable within said bottom panel receiving grooves of said pair of side panels; and (e) A bottom panel having upper and lower faces adapted to be received within said grooves disposed adjacent and parallel to the lower marginal edges of said front and side panels and within said inner groove defined in said inner face of said support rail, portions of said upper and lower faces of said bottom panel being in close engagement with said faces of said inner groove of said support rail.

* * * * *